US010358839B1

(12) United States Patent
Mohamed et al.

(10) Patent No.: US 10,358,839 B1
(45) Date of Patent: Jul. 23, 2019

(54) CROSS-BRACING ARRANGEMENT FOR STRUCTURES

(71) Applicant: Valmont Industries, Inc., Omaha, NE (US)

(72) Inventors: Diaaeldin Mohamed, La Vista, NE (US); Anthony J. Hansen, Elkhorn, NE (US); Tony Schuler, Hominy, OK (US); Shannon R. Eggert, Lincoln, NE (US)

(73) Assignee: Valmont Industries, Inc., Omaha, NE (US)

( * ) Notice: Subject to any disclaimer, the term of this patent is extended or adjusted under 35 U.S.C. 154(b) by 0 days.

(21) Appl. No.: 15/498,665

(22) Filed: Apr. 27, 2017

Related U.S. Application Data

(60) Provisional application No. 62/361,521, filed on Jul. 13, 2016.

(51) Int. Cl.
*E04H 12/24* (2006.01)
*E04H 12/08* (2006.01)
*E04B 1/19* (2006.01)

(52) U.S. Cl.
CPC ..... *E04H 12/24* (2013.01); *E04B 1/19* (2013.01); *E04H 12/08* (2013.01); *E04H 12/085* (2013.01); *E04B 2001/1924* (2013.01); *E04B 2001/1927* (2013.01); *E04B 2001/1957* (2013.01)

(58) Field of Classification Search
CPC ... E04H 12/24; E04H 9/028; E04C 2003/026; E04C 3/32; E04B 1/2403; E04B 2001/2415; E04B 2001/2496
See application file for complete search history.

(56) References Cited

U.S. PATENT DOCUMENTS

| | | | | |
|---|---|---|---|---|
| 502,200 | A | 11/1893 | Pearson | |
| 879,524 | A | 2/1908 | Collins | |
| 2,029,121 | A | 1/1936 | Seeman | |
| 2,844,643 | A * | 7/1958 | Cofer | E04H 12/04 174/2 |
| 3,062,336 | A | 11/1962 | Baxter | |
| 3,367,080 | A | 2/1968 | McClelland | |
| 3,540,111 | A * | 11/1970 | Wainwright | B21H 7/00 174/45 R |
| 3,574,981 | A | 4/1971 | Henschen | |
| 4,233,697 | A * | 11/1980 | Cornwall | E03D 11/16 138/89 |
| 4,313,434 | A * | 2/1982 | Segal | A61B 17/7275 128/DIG. 20 |
| 4,314,434 | A * | 2/1982 | Meisberger | E04H 12/24 174/45 R |
| 4,641,477 | A | 2/1987 | Schleck | |
| 4,878,160 | A * | 10/1989 | Reneau | E04H 12/003 362/269 |

(Continued)

*Primary Examiner* — Brian E Glessner
*Assistant Examiner* — Daniel J Kenny
(74) *Attorney, Agent, or Firm* — Duncan Galloway Egan Greenwald PLLC; Theresa Camoriano; Guillermo Camoriano

(57) ABSTRACT

A cross-bracing arrangement is provided for bracing between two hollow structural poles. The bracing arrangement provides for pivoting between the cross-brace and each of the hollow structural poles, for adjustment of the effective length of the cross-brace, and for angular adjustment of one end of the cross-brace relative to the other end of the cross-brace.

8 Claims, 3 Drawing Sheets

(56) References Cited

U.S. PATENT DOCUMENTS

| | | | | |
|---|---|---|---|---|
| 5,156,395 | A * | 10/1992 | Smith | A63B 63/083 248/188.4 |
| 6,834,469 | B2 * | 12/2004 | Fingerson | E04H 12/24 52/309.11 |
| 6,971,212 | B1 * | 12/2005 | Johnson | E04H 12/24 403/269 |
| 7,829,165 | B2 * | 11/2010 | Grandominico | B29C 65/08 280/423.1 |
| 8,171,695 | B2 | 5/2012 | Jackson | |
| 8,322,105 | B2 * | 12/2012 | Williams | E04C 3/36 52/651.01 |
| 8,353,135 | B2 | 1/2013 | Sarkisian | |
| 9,197,051 | B2 * | 11/2015 | Stenzel | H02G 7/05 |
| 2008/0060285 | A1 * | 3/2008 | Lefebvre | E04B 1/2403 52/149 |
| 2010/0293880 | A1 * | 11/2010 | Reichartz | E04H 12/24 52/651.07 |
| 2014/0340244 | A1 * | 11/2014 | Bischoff | G08G 1/005 340/944 |
| 2016/0060888 | A1 | 3/2016 | Reaveley | |
| 2016/0115687 | A1 * | 4/2016 | Lanzilotta | E04B 2/60 52/481.1 |

* cited by examiner

CROSS-BRACING ARRANGEMENT FOR STRUCTURES

This application claims priority from U.S. Provisional Application Ser. 62/361,521 filed Jul. 13, 2016.

BACKGROUND

The present invention relates to structures, such as electric power transmission towers, which include a plurality of hollow structural poles, and, more particularly, to a cross-bracing arrangement for use in those structures.

In the prior art, there is a variety of types of cross-bracing used in structures. However, the cross-bracing may be difficult to install or to adjust, and it may have weak points. It should be noted that, when installing a structure, there is some amount of tolerance or variance from the design dimensions, so the ability to adjust the effective length of the cross-brace member, to adjust the angle of the cross-brace member relative to the structural pole, and to rotationally adjust one end of the cross-brace member relative to the other end about the elongated axis of the cross-brace member without weakening the cross-bracing is desirable.

SUMMARY

The present invention provides a cross-bracing arrangement that is easy to install and to adjust in the desired ways described above. The cross-bracing arrangement may be used both in tension and in compression.

DESCRIPTION

Figure 1:
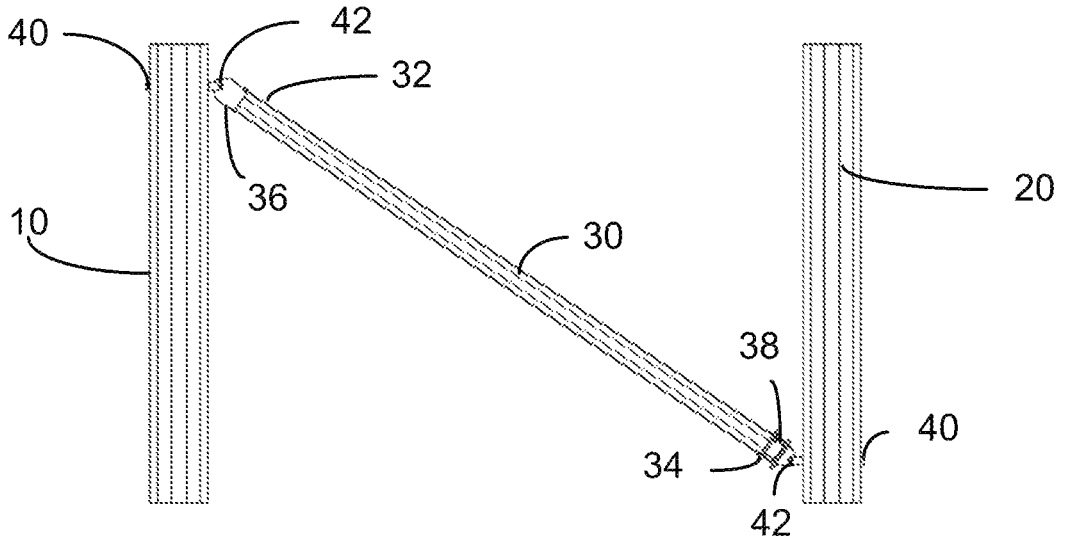
FIG. 1 is a front view of a bracing arrangement.

FIGS. 1-6 show a cross-bracing arrangement in which first and second hollow, structural poles 10, 20 are connected by a cross-bracing member 30. In this embodiment, the poles 10, 20 and cross-bracing member 30 have multi-sided walls, which form hollow metal poles, with hexagonal or dodecahedral cross-sections, but the walls may have other cross-sections, such as octagonal, oval, or circular cross-sections, for example.

The cross-bracing member 30 has a first end 32 that is pivotably connected to the first structural pole 10 and a second end 34 that is pivotably connected to the second structural pole 20. This embodiment shows first and second elongated base members 40. Each base member 40 is a metal piece, which extends completely through its respective structural pole 10, 20 and is welded at welds 41 (See FIG. 4) to its respective structural pole 10, 20 at each location where the elongated base member 40 extends through and contacts the wall of the respective structural pole 10, 20. Each of the elongated base members 40 includes a portion projecting outside of the respective structural pole 10, 20 which defines a through opening that receives a pivot pin 42 about which the cross-bracing member 30 may pivot relative to the respective structural pole 10, 20. Each pivot axis is transverse to the elongated central axis of the cross-bracing member 30. The pivot connections at each end of the cross-bracing member 30 allow the installer to adjust the angles between the cross-bracing member 30 and the structural poles 10, 20 during installation to compensate for small differences in spacing between the structural poles 10, 20 as installed and the design spacing.

Figure 2:
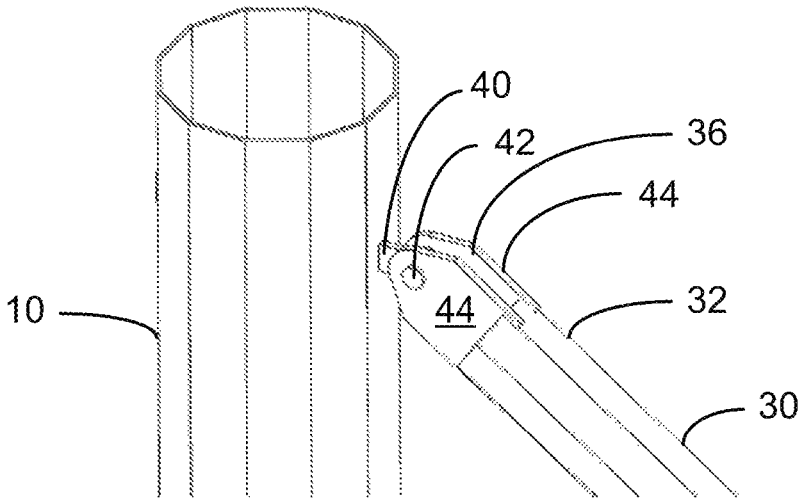
FIG. 2 is an enlarged, broken-away perspective view of the upper left portion of the bracing arrangement of FIG. 1.
Figure 3:
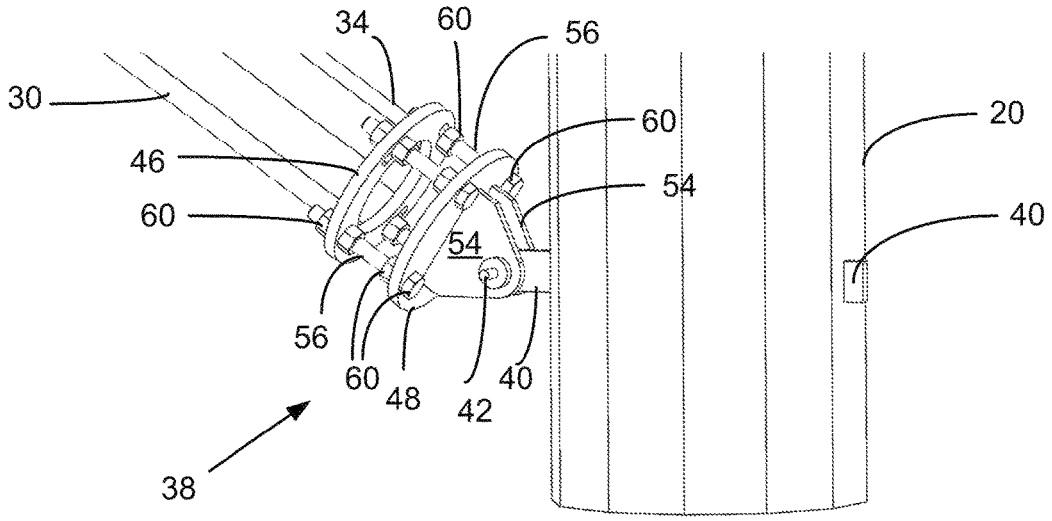
FIG. 3 is an enlarged, broken-away perspective view of the lower right portion of the bracing arrangement of FIG. 1.
Figure 4:
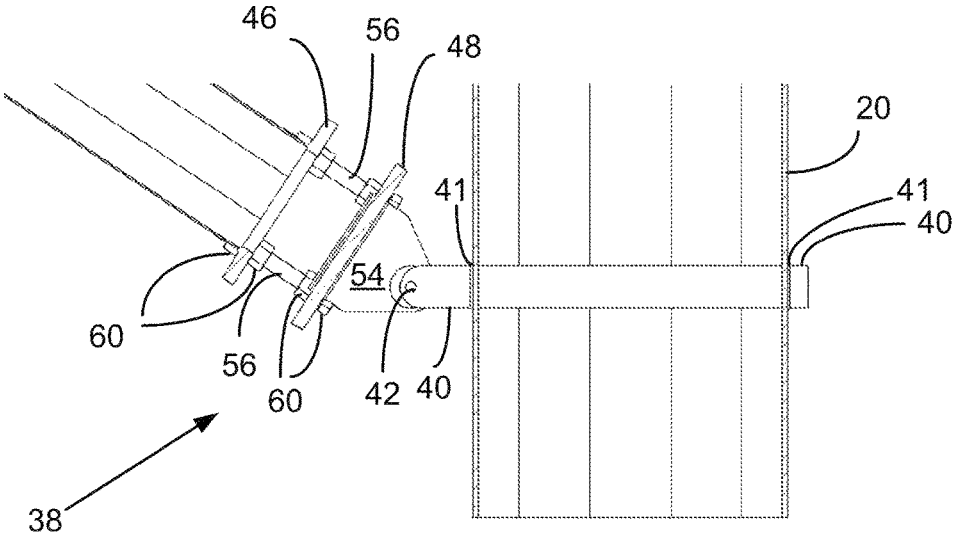
FIG. 4 is a section view of the portion shown in FIG. 3.
Figure 5:
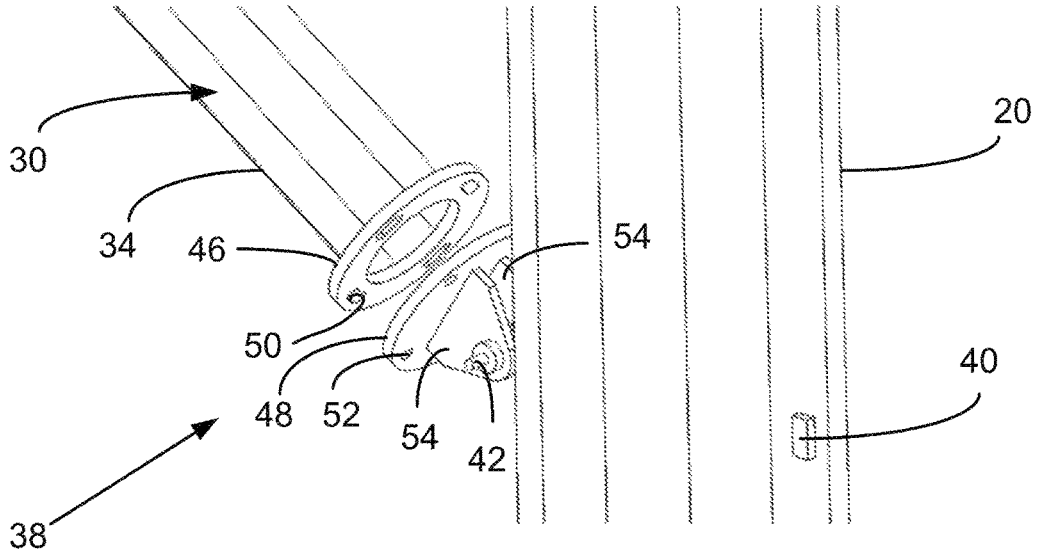
FIG. 5 is the same view as FIG. 3, but with the bolts and nuts removed.
Figure 6:
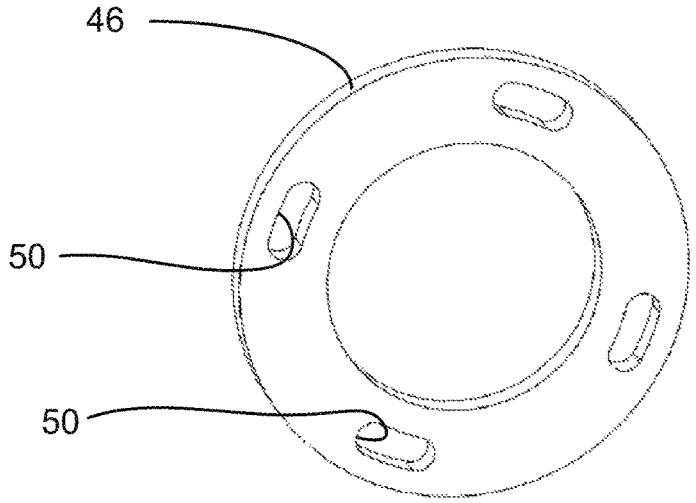
FIG. 6 is a view of the flange at the lower end of the cross-brace of FIG. 3.

As best appreciated in FIGS. 2 and 3, there is a first bracket 36 secured to the first end 32 of the cross-bracing member 30 and a second bracket 38 secured to the second end 34 of the cross-bracing member 30. Each of the brackets 36, 38 also defines through openings that receive one of the respective pivot pins 42 to permit the cross-bracing member 30 to pivot about the respective pivot pin 42.

As shown in FIG. 2, the first bracket 36 includes first and second parallel plates 44 which are embedded into the first end 32 of the cross-brace member 30 and are attached thereto, as by welding. The first and second plates 44 straddle the elongated base 40 on the first pole 10, and the openings in the first and second plates 44 are aligned with the opening in the elongated base 40 on the first pole 10 so that the aligned openings in the plates 44 and the base 40 receive the pivot pin 42.

The second bracket 38 includes a first eared member 46 that is welded to the second end 34 of the cross-brace member 30 and a second eared member 48, which is parallel to the first eared member 46. Third and fourth parallel plates 54 project from the second eared member 48 and straddle the elongated base 40 on the second pole 20, and openings in the third and fourth plates 54 are aligned with the opening in the elongated base 40 on the second pole 20 and receive the respective pivot pin 42 to permit the cross-bracing member 30 to pivot relative to the second structural pole 20.

The first eared member 46 and the second eared member 48 lie in parallel planes and define a plurality of through openings 50, 52 (See also FIG. 5), with each respective opening 50 in the first eared member 46 lying opposite a through opening 52 in the second eared member 48. As best appreciated in FIG. 6, the through openings 50 in the first eared member 46 are elongated or slotted, while the through openings 52 in the second eared member 48 are circular, which allows for a small rotational adjustment of the second end 34 of the cross-brace member 30 relative to the second structural pole 20 about the elongated central axis of the cross-brace member 30 during installation, again compensating for differences between the actual arrangement and the design. A plurality of threaded rods 56 extends between the first and second eared members 46, 48. Each of the threaded rods 56 extends through one of the through openings 50 in the first eared member 46 and through one of the through openings 52 in the second eared member 48 and is held in place by a plurality of nuts 60. It should be noted that there is a nut 60 threaded onto each of the threaded rods 56 adjacent to each face of each eared member 46, 48. This permits infinite adjustment of the spacing between the eared members 46, 48 (adjustment of the effective length of the cross-brace member 30) as well as providing securement of the eared members 46, 48 to each other. The ability of the installer to adjust the effective length of the cross-brace member 30 also enables the installer to compensate for slight dimensional differences between the actual, installed arrangement and the design.

It should be noted that the second eared member 48 also may have elongated (or slotted) openings like the elongated openings 50 in the eared first member 46, if desired, which would result in additional range of rotational adjustment of the cross-brace member about the longitudinal axis of the cross-brace member 30.

In order to assemble the cross-brace member 30 onto the first and second poles 10, 20, the first bracket 36 is assembled to the first elongated base 40 on the first pole 10 by inserting the pivot pin 42 through the aligned through openings in the parallel plates 44 and in the first elongated base 40. In this case, the pivot pin 42 has a head at one end and is threaded at the other end and receives a nut at the threaded end to secure the pivot pin 42 in place.

The second eared member 48 of the second bracket 38 is similarly assembled to the second elongated base 40 on the second pole 20, using a second pivot pin 42 that is secured in place by a nut.

Then, the second end 34 of the cross-brace member 30 is brought into position with the first eared member 46 parallel to the second eared member 48. Then the threaded rods 56 are inserted through the respective aligned openings 50, 52 in the first and second eared members 46, 48 respectively. Once a first end of one of the threaded rods 56 passes through one of the aligned openings 50, 52, two intermediate nuts 60 are threaded onto the first end, and then the first end of the threaded rod 56 is moved through the other of the aligned openings 50, 52. Then, outer nuts 60 are threaded onto the two free ends of the threaded rod 56. At this point, there are two inner nuts 60 on the threaded rod 56 between the first and second eared members 46, 48, and there is an outer nut at each end of the threaded rod 56, outside the first and second eared members 46, 48. This process is repeated until all the threaded rods 56 are assembled through their respective aligned openings 50, 52. The nuts 60 are then adjusted so that, on each threaded rod 56, one of the inner nuts 60 abuts the inner face of the first eared member 46, one of the inner nuts 60 abuts the inner face of the second eared member 48, one of the outer nuts abuts the outer face of the first eared member 46, and one of the outer nuts abuts the outer face of the second eared member 48, as shown in FIG. 3. All the nuts 60 are tightened to fix the spacing between the first and second eared members 46, 48 and to fix the first and second eared members 46, 48 together. This provides a strong, rigid joint between the first and second eared members 46, 48.

Once the arrangement has been installed, the effective length of the cross-brace member 30 is fixed, and the angular adjustment between the two ends of the cross-brace member 30 is fixed.

In this embodiment, the first and second eared members 46, 48 are circular flanges.

It should be noted that by selectively loosening some of the nuts 60 and tightening the opposing nuts on the same rod (the corresponding nut on the same rod but on the opposite side of the eared member 46, 48) it is possible to place the cross-brace member 30 in tension or in compression, as desired. Once the level of tension or compression has been reached, the opposing nuts which had been loosened are retightened.

It will be obvious to those skilled in the art that modifications may be made to the embodiment described above without departing from the scope of the invention as claimed.

What is claimed is:

1. A cross-bracing arrangement, comprising:

first and second hollow poles;

a first elongated base member extending through and welded to said first hollow pole, said first elongated base member including a portion projecting outside of said first hollow pole which defines a first through opening;

a second elongated base member extending through and welded to said second hollow pole, said second elongated base member including a portion projecting outside of said second hollow pole which defines a second through opening;

a cross-brace member having first and second ends;

a first bracket secured to said cross brace member at said first end and pivotably connected to said first elongated base member at said first through opening;

a second bracket secured to said cross brace member at said second end and pivotably connected to said second elongated base member at said second through opening;

at least one of said first and second brackets including a first eared member welded to the respective end of said cross brace member;

a second eared member parallel to said first eared member, each of said first and second eared members defining a plurality of through openings; and a plurality of threaded rods, each of said threaded rods extending through one of the through openings in said first eared member and through one of the through openings in said second eared member.

2. A cross-bracing arrangement as recited in claim 1, and further comprising a plurality of nuts, wherein said nuts are threaded onto said threaded rods and secure said threaded rods and said eared members together.

3. A cross-bracing arrangement as recited in claim 2, wherein the through openings in at least one of said first and second eared members are elongated openings to permit angular adjustment of said first eared member relative to said second eared member.

4. A cross-bracing arrangement as recited in claim 3, wherein each of said first and second eared members is a circular flange.

5. A cross-bracing arrangement, comprising:

first and second spaced-apart hollow poles;

a cross-brace member having a central elongated axis and first and second ends;

a first bracket secured to said cross-brace member at said first end and being pivotably mounted to said first hollow pole at a first pivot connection for pivoting about a first pivot axis transverse to said central elongated axis;

a second bracket secured to said cross-brace member at said second end and being pivotably mounted to said second hollow pole at a second pivot connection for pivoting about a second pivot axis transverse to said central elongated axis;

at least one of said first and second brackets including a first eared member secured to the respective end of said cross brace member and a second eared member parallel to said first eared member, each of said first and second eared members defining a plurality of through openings; and a plurality of threaded rods, each of said threaded rods extending through one of the through openings in said first eared member and through one of the through openings in said second eared member for adjusting the effective length of said cross-brace member.

6. A cross-bracing arrangement as recited in claim 5, wherein the through openings in at least one of said first and second eared members are elongated openings to permit angular adjustment of said first eared member relative to said second eared member.

7. A cross-bracing arrangement as recited in claim 6, wherein said first pivot connection includes a first pivot pin extending through said first bracket and through a first base member which extends through and is welded to said first hollow pole.

8. A cross-bracing arrangement as recited in claim 7, wherein said second pivot connection includes a second pivot pin extending through said second bracket and through a second base member which extends through and is welded to said second hollow pole.

* * * * *